US006523485B1

(12) United States Patent
Cipolla

(10) Patent No.: US 6,523,485 B1
(45) Date of Patent: Feb. 25, 2003

(54) PORTABLE COLLAPSIBLE PICNIC TABLE APPARATUS

(76) Inventor: Michael A. Cipolla, 20942 Sunrise Dr., Boca Raton, FL (US) 33433

( * ) Notice: Subject to any disclaimer, the term of this patent is extended or adjusted under 35 U.S.C. 154(b) by 0 days.

(21) Appl. No.: 09/725,007

(22) Filed: Nov. 29, 2000

(51) Int. Cl.[7] ..... A47B 85/00
(52) U.S. Cl. ..... 108/14; 108/19; 108/50.11
(58) Field of Search ..... 108/14, 18, 19, 108/11, 38, 50.12, 167, 166, 169, 174, 50.11; 312/241; 190/11, 12 A

(56) References Cited

U.S. PATENT DOCUMENTS 2,508,627 A * 5/1950 Spiegel et al. ..... 108/19
2,652,300 A * 9/1953 Graber et al. ..... 108/174 X
2,936,204 A * 5/1960 Sofi ..... 108/50.12 X
3,006,705 A * 10/1961 Williams et al. ..... 108/14
4,571,740 A * 2/1986 Kirby et al. ..... 312/7.1 X
4,609,192 A * 9/1986 Bratcher ..... 108/19 X
4,887,536 A * 12/1989 Teichner ..... 108/38 X
5,076,405 A * 12/1991 Modica ..... 190/12 A X
5,143,108 A * 9/1992 Kenney

* cited by examiner

*Primary Examiner*—Janet M. Wilkens

(57) ABSTRACT

A combined portable, collapsible, picnic table. The picnic table includes two similar table top portions hinged together for movement from a co-planar relationship in which they provide the normal table top, to a folded relationship in which the undersides of the portions lie parallel and spaced apart to provide a storage space. The portions each have one rectangular support, which may be hingedly attached so as to be foldable against the undersides of the table top portions and fit within the space between these portions when folded. These rectangular supports allow the table top to be supported horizontally at a relatively low height. An additional support having four legs which can be releasably attached to the underside of the table is provided, the additional support supporting the top portion at a height substantially higher than the rectangular support. Picnic accessories including an umbrella, tarp, picnic basket, a radio, headphones, and audio speakers are contained to fit within the storage space when the table is folded.

6 Claims, 3 Drawing Sheets

PORTABLE COLLAPSIBLE PICNIC TABLE APPARATUS

BACKGROUND OF THE INVENTION

1. Field of the Invention

The present invention relates to recreational equipment. More specifically, it relates to a portable picnic table, which can be collapsed for portability and contains accessories which facilitate set up of a picnic area.

The invention provides a combined portable, collapsible, picnic table. The picnic table comprises two similar table top portions hinged together for movement from a co-planar relationship in which they provide the normal table top, to a folded relationship in which the undersides of the portions lie substantially parallel and spaced apart to provide a storage space. The portions each have one rectangular support member hingedly attached thereto so as to be foldable against the undersides of the table top portions and so as to fit within the space between these portions when folded. These rectangular support members allow the table top to be supported horizontally at a relatively low height. An additional support means comprising four legs which can be releasably attached to the underside of the table is provided, the additional support means supporting the top portion at a height substantially higher than the rectangular support member. Picnic accessories including an umbrella, tarp, picnic basket, a radio, headphones, and audio speakers are releasably held by retaining means on the underside of the table top portions and is capable of fitting within the storage space when the table is folded.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

As will be seen, the simplicity and effectiveness of my invention is not rivaled in the prior art.

U.S. Pat. No. 4,415,199 issued to Wright, discloses a folding picnic table. The apparatus includes opposing benches and several brackets and retaining members to maintain the table securely in an erected state. The present invention contemplates a compact picnic table which is fully collapsible, and includes numerous accessories which may be stored within the apparatus when collapsed.

U.S. Pat. No. 2,190,222 issued to Strasser discloses a portable table structure having a centrally disposed post which supports an umbrella above the table surface. Anchoring means support the port in the vertical position, with the post in turn supporting the table. By contrast, the apparatus of the instant invention includes a table top and an umbrella. A tarp may be used in place of the umbrella to provide protection from precipitation. Other accessories are provided and are containable within the apparatus.

U.S. Pat. No. 4,064,812 issued to Commanda discloses a combination picnic table and grill which is collapsible. By contrast, the apparatus of the instant invention is concerned with a collapsible picnic table which includes all of the accessories required for a picnic.

None of the above inventions and patents, taken either singly or in combination, is seen to describe the instant invention as claimed.

SUMMARY OF THE INVENTION

Briefly, the invention comprises a collapsible picnic table apparatus having a plurality of accessories securely containable within the apparatus when collapsed. The apparatus allows for storage and transportation of all of the most commonly used picnic accessories in a secure and compact manner.

Accordingly, it is a principal object of the invention to provide a new and improved picnic table apparatus which overcomes the disadvantages of the prior art in a simple but effective manner.

It is a major object of this invention to provide an improved picnic table apparatus which is compact, collapsible, and is capable of containing multiple accessories.

It is an object of this invention to provide an improved picnic table apparatus having an interior space when collapsed.

It is another object to provide an improved picnic table apparatus having a plurality of commonly used picnic accessories securely contained within an interior space.

It is another object of the invention to provide an improved picnic table apparatus having means for supporting an umbrella when fully extended.

It is another object of the invention to provide an improved picnic table apparatus having means for adjusting the vertical height at which the table top is supported.

It is another object of the invention to provide an improved picnic table apparatus having a built in electronic entertainment center.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification.

The present invention meets or exceeds all the above objects and goals. Upon further study of the specification and appended claims, further objects and advantages of this invention will become apparent to those skilled in the art.

DETAILED DESCRIPTION

Figure 1:
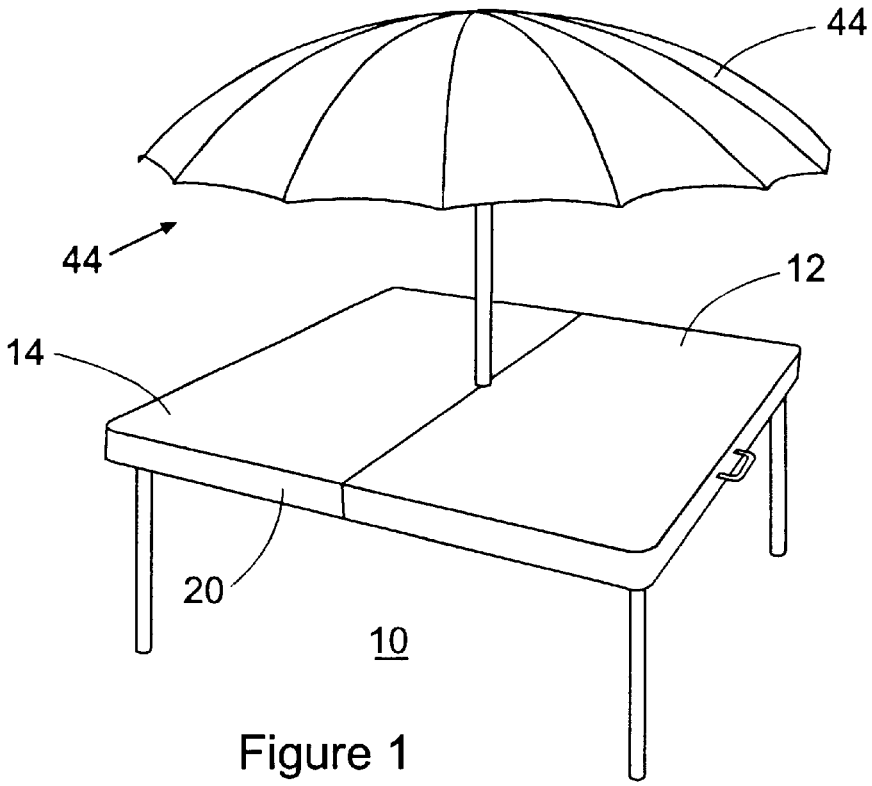
FIG. 1 is a perspective view of the picnic table apparatus of the invention set up for use.

Referring now to FIGS. 1–5 the invention, generally indicated by the numeral 10 is shown. The picnic table comprises first and second table top portions 12 and 14, each forming one half of the table top, and preferably hinged together by a long piano type hinge 16. Each table top portion 12, 14 comprises a rectangular, flat, board which is surrounded on its four sides by continuous sidewalls 20 which extend downwardly from the underside 21 of the board when the table top portions 12, 14 are set up for use in the unfolded position. The hinge 12 has its plates connected to the lower side of the adjacent sidewalls of the two table top portions 12, 14. With this arrangement, the two portions 12, 14 can be folded together with normally lower sides facing each other but separated by an amount equivalent to twice the height of the sidewalls 20, thus forming a space 22 for the storage of picnic accessories which will be described in more detail later. In the folded position, handles 23 are spaced so as to allow for simultaneous grasping thereof to effect closure and carrying of the apparatus. Alternatively, a closure means such as a latch (not shown) may be provided in addition to the handles 23.

Two support means are provided to allow the user to selectively support the apparatus 10 at two different heights. A first, lower height is accommodated by an opposing pair of pivotable support members 26. The support members 26 may be made from a series of interconnected tubular rods into a rectangular shape. The rectangular shape of the support members 26 allow them to be used to contain relatively large loose items, such as tablecloths or blankets, so as to prevent excessive movement of these items within the apparatus 10 when the apparatus 10 is carried. Each of the support members 26 is secured to the underside 21 of the respective table top portions by a clamp 28 which allows for rotation of the support members from an extended position into a collapsed position. One of the support members 26 is shown securing a tarp 40 to the underside 21 of the table top portion 12. A second height is accommodated by support rods 30. The support rods 30 are sized for insertion into apertures 32 formed in the undersides 21 of the table top portions 12, 14. Using support members 26, the table top portions 12, 14 are supported a few inches above the ground allowing the user to set up for a picnic while sitting on the ground. Support rods 30 allow the user to set up the apparatus so that the table top portions 12, 14 are raised sufficiently to allow for sitting in folding chairs or other portable seating.

Figure 2:
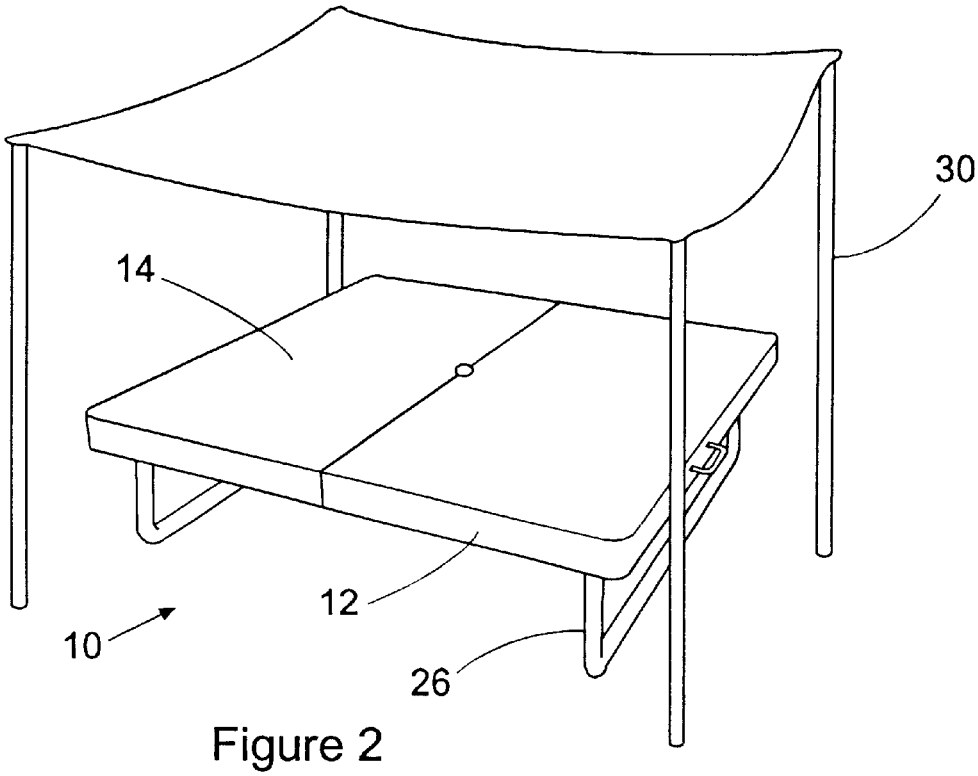
FIG. 2 is a perspective view of an alternative set up for the apparatus of the invention.
Figure 3:
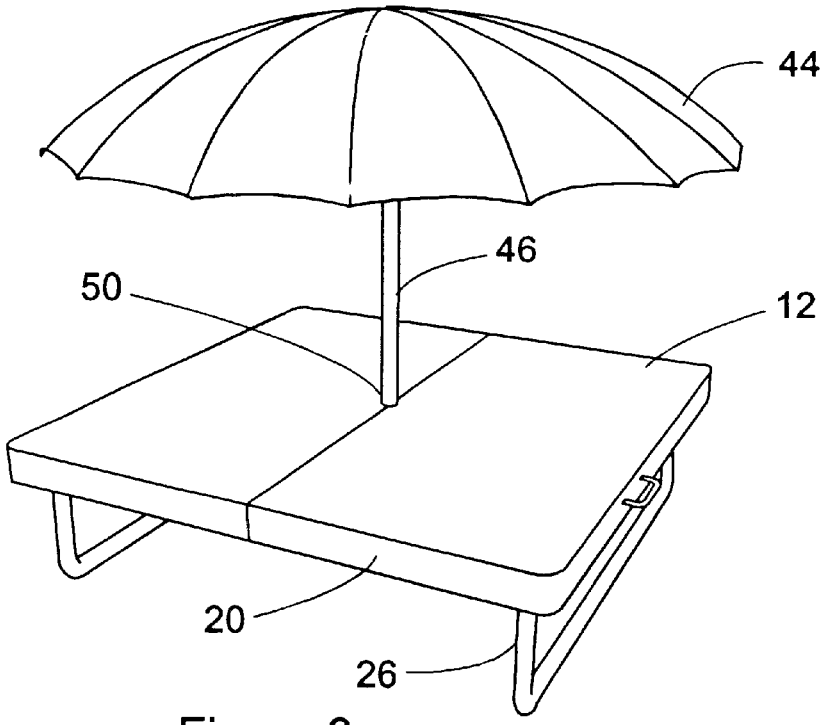
FIG. 3 is a perspective view of another alternative set up for the apparatus of the invention.
Figure 4:
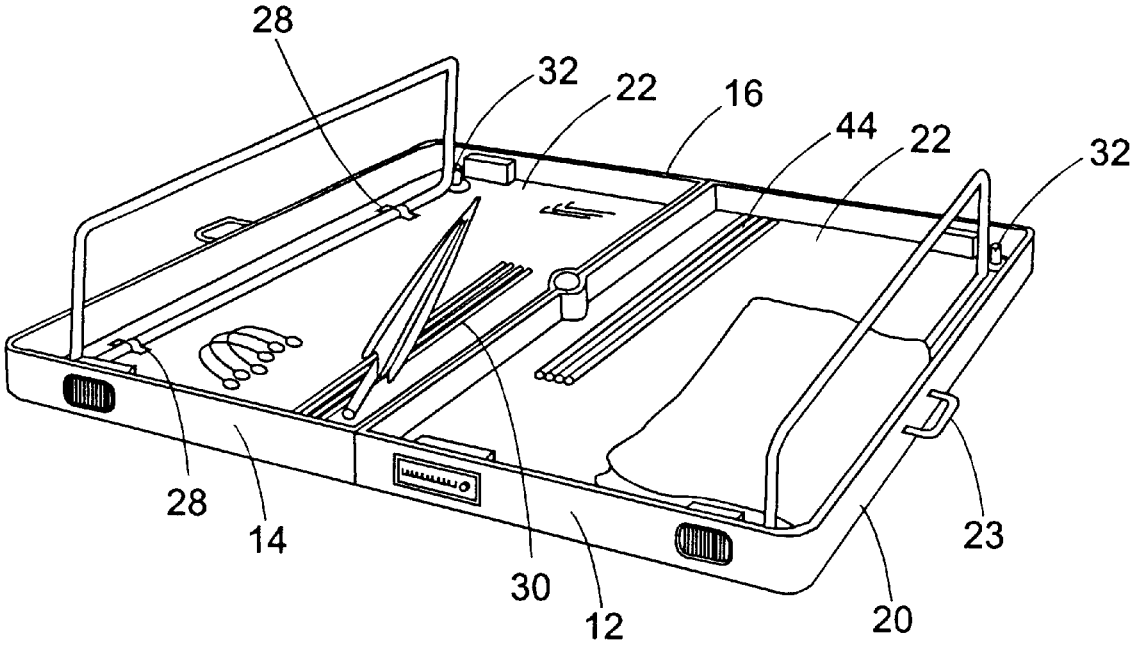
FIG. 4 is a perspective view of the apparatus with the accessories contained therein.
Figure 5:
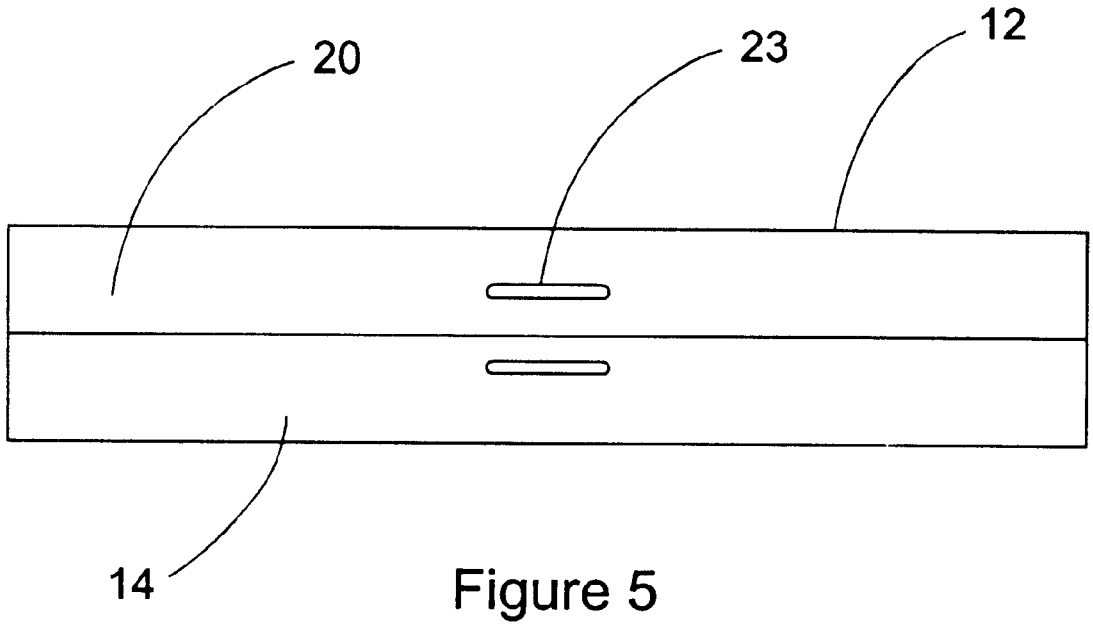
FIG. 5 is a side view of the apparatus in the folded position.

In order to further accommodate use of the apparatus 10 while supported at the lower height with support members 26, tarp 40 is provided. The tarp 40 preferably has at least twice the surface area of the table top portions 12, 14, and may be folded for compact storage within space 22. In the event that the ground is damp, the tarp 40 may be spread thereon with the apparatus 10 centrally located on the tarp 40. Alternatively, as shown in FIG. 2, the tarp 40 may be supported above the table top portion 12, 14 to provide cover for both the users and any items which may be disposed upon the table. Efficiency of the apparatus is enhanced by using rods 30 to support the tarp 40.

A canopy or umbrella 44 may be suspended above the table top portions 12, 14 by support poles 46. Poles 46 may be telescopically or sequentially connected to allow for adjusting the support height of the umbrella 44. A first end of the pole 46 may be inserted into an aperture 48 formed in the underside of the umbrella 44 with the opposing end of the pole 46 inserted into socket 50 formed between table top portions 12, 14. Both the poles 46 and support rods 30 may be clamped to the undersides 21 of the table top portions 12, 14 for storage within space 22 using a suitable clamping means (not shown).

An entertainment system is disposed within the space 22. The system consists of a radio receiver 52, which preferably includes a CD player, cassette, associated amplifier and speakers 54. Other suitably sized electronic components may also be built into the apparatus. The receiver 52 and any opening necessary to receive recorded media (e.g., CD or cassette) are mounted flush with the exterior surface of the sidewalls 20, as are speakers 54. Thus, the entertainment system is accessible and operable without being physically removed from the space 22.

In operation, the apparatus 10 is carried to the picnic site where it may then be opened and set up as desired. If there are chairs, support members 30 are used to support the table top portions 12, 14 at an appropriate height, and umbrella 44 may be used to provide shade from the sun or protection from precipitation. If the user desires to picnic while sitting on the ground, foldable support members 26 may be used, with either umbrella 44 or tarp 40 suspended above table top portions 12, 14.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the claims.

What is claimed is:

1. A portable picnic table apparatus comprising:

a pair of table top portions hingedly connected for movement between a coplanar relationship wherein a horizontal support surface is provided and a folded relationship wherein opposing undersides of said table top portions are supported in a spaced apart relation to provide a storage space;

a plurality of accessories securely attached to said undersides of said table top portions;

a first support means for supporting said horizontal support surface at a first vertical height;

a second support means for supporting said horizontal support surface at a second vertical height;

said first support means hingedly attached to the undersides of said table top portions for pivotal movement between a retracted position and an extended supporting position, and said second support means is securely attached to the undersides of said table top portions;

said accessories including a tarp which can be supported above said table by said second support means.

2. The apparatus of claim 1 wherein said accessories include audio equipment.

3. A portable picnic table apparatus comprising:

a pair of table top portions hingedly connected for movement between a coplanar relationship wherein a horizontal support surface is provided and a folded relationship wherein opposing undersides of said table top portions are supported in a spaced apart relation to provide a storage space;

a plurality of accessories securely attached to said undersides of said table top portions, said accessories including audio equipment, said audio equipment includes control means and loudspeakers, said control means positioned on an edge portion of one of said table top portions, said control means accessible whether said table top portions are in said folded relationship or said spaced apart relationship.

4. The apparatus of claim 3 wherein said loudspeakers are mounted to project an audible output through openings formed in said edge portion of one of said table top portions.

5. The apparatus of claim 3 including a first support means for supporting said horizontal support surface at a first vertical height;

a second support means for supporting said horizontal support surface at a second vertical height;

said first support means hingedly attached to the undersides of said table top portions for pivotal movement between a retracted position and an extended supporting position, and said second support means is securely attached to the undersides of said table top portions.

6. The apparatus of claim 3 including a tarp which can be supported above said table by said second support means.

* * * * *